US006659687B1

(12) United States Patent
Donlin et al.

(10) Patent No.: US 6,659,687 B1
(45) Date of Patent: Dec. 9, 2003

(54) SUBTERRANEAN FLUID DISTRIBUTION AND DRAINAGE SYSTEM

(76) Inventors: James Donlin, 56 Lisa Dr., South Windsor, CT (US) 06074; Joseph Glasser, 58 Henley Way, West Hartford, CT (US) 06117

( * ) Notice: Subject to any disclaimer, the term of this patent is extended or adjusted under 35 U.S.C. 154(b) by 0 days.

(21) Appl. No.: 10/045,748

(22) Filed: Jan. 10, 2002

Related U.S. Application Data

(60) Provisional application No. 60/261,441, filed on Jan. 12, 2001.

(51) Int. Cl.[7] ..... E02B 11/00

(52) U.S. Cl. ..... 405/43; 405/45; 405/36; 52/783.18; 52/169.5

(58) Field of Search ..... 405/36, 43, 45, 405/49, 50, 302.7; 52/783.18, 169.5

(56) References Cited

U.S. PATENT DOCUMENTS

| | | | | | |
|---|---|---|---|---|---|
| 2,161,999 | A | * | 6/1939 | Christie et al. | 210/293 |
| 3,403,519 | A | * | 10/1968 | Balko | 405/45 |
| 4,490,072 | A | * | 12/1984 | Glasser | 405/45 |
| 4,639,165 | A | * | 1/1987 | Flecknoe-Brown | 405/45 |
| 4,880,333 | A | * | 11/1989 | Glasser | 405/43 |
| 4,917,536 | A | * | 4/1990 | Glasser | 405/45 |
| 5,624,204 | A | * | 4/1997 | Dorsemaine | 405/52 |
| 5,810,510 | A | * | 9/1998 | Urriola | 405/45 |
| 5,951,203 | A | * | 9/1999 | Laak | 405/45 |
| 6,048,131 | A | * | 4/2000 | Laak | 405/43 |
| 6,176,065 | B1 | * | 1/2001 | Honda | 52/783.18 |

FOREIGN PATENT DOCUMENTS

| | | | | |
|---|---|---|---|---|
| JP | 05272124 A | * | 3/1992 | E02D/3/10 |
| JP | 05106217 A | * | 4/1993 | E02D/3/10 |

* cited by examiner

*Primary Examiner*—Robert J. Sandy
*Assistant Examiner*—Katherine Mitchell
(74) *Attorney, Agent, or Firm*—Alix, Yale & Ristas, LLP

(57) ABSTRACT

Disclosed is a system for filtering and distributing fluids to the subterranean soil environment. The system includes spaced core sheets that are typically partially enveloped with fluid permeable fabric. In one embodiment the core sheets are arranged in an alternating wide and narrow configuration. Fluid is transferred from a pipe to the core sheet edges and travels along the core sheets and through the fabric into the subsurface environment. In another embodiment a transfer sheet is provided adjacent at least some of the core sheet edges. Fluid is transferred from a pipe to the transfer sheet for subsequent distribution to the core sheet edges for travel along the core sheets and through the fabric into the subsurface environment.

26 Claims, 6 Drawing Sheets

SUBTERRANEAN FLUID DISTRIBUTION AND DRAINAGE SYSTEM

This application claims the benefit of U.S. Provisional Patent Application No. 60/261,441, filed Jan. 12, 2001.

This invention relates generally to systems for filtering and distributing fluids to the subterranean soil environment. More particularly, this invention relates to a system capable of filtering and distributing fluid leachate from a septic tank or the like to the subterranean subsoil environment.

BACKGROUND OF THE INVENTION

Subterranean fluid leachate carrying systems are known in the prior art. In the system described in U.S. Pat. No. 4,880,333, a plurality of parallel core sheets of identical geometry are wrapped with a leachate permeable geotextile fabric so as to provide a continuous, horizontally extending in-drain for placement in an excavation. The system is preferably buried in a layer of sand or other fill. Leachate can be fed from a septic system or tank through a wide fluid conduit provided over the in-drain. The wide fluid conduit distributes the leachate over substantially the entirety of the top of the in-drain for subsequent distribution along the core sheets to the subsoil environment. It has been asserted that when identical parallel core sheets of the type used in U.S. Pat. No. 4,880,333 are stacked together with only a geotextile fabric as separation between them, during back filling and/or handling of the system the initially separated core sheets with the wrapped geotextile fabric may be compressed, one core sheet nesting into the other. This nesting leads to areas of the overall system, which are less efficient at filtration and distribution of leachate to the subsoil environment. Additionally, as the geotextile fabric permeability may lessen due to, for example, biological growth, the leachate level around the adjacent core sheet rises. However, the system of U.S. Pat. No. 4,880,333 does not provide a mechanism to redistribute the leachate accumulation from one core sheet to another core sheet, decreasing the long-term efficiency of the system.

The system described in U.S. Pat. No. 6,048,131 discloses a plurality of parallel, alternating core sheets and spacers of specified dimension, wrapped in an over and under serpentine fashion with a leachate permeable geotextile fabric so as to provide a continuous, horizontally extending in-drain for placement in an excavation. The spacers comprise inert material such as perlite sandwiched between spacer sheets of different pitch diameter than the core sheets. The system is preferably buried in a layer of sand or other fill so that leachate can be fed from a septic system or tank through a fluid conduit overlying the in-drain for purposes of distributing the leachate downwardly through the in-drain to the subsoil environment. The disclosure of U.S. Pat. No. 6,048,131 asserts that use of alternating sizes of core sheets and spacers lessens the tendency of the core sheets to nest. This reference also briefly mentions the use of perforated core sheets and states that the perforations bleed leachate through the fabric into the adjacent spacer. This system does not provide a mechanism for leachate movement to non-adjacent core sheets or spacers. Thus, an optimum mechanism to redistribute leachate accumulation from one core sheet to another core sheet is not provided.

SUMMARY OF THE INVENTION

An object of the invention is to provide an improved system for filtration and distribution of fluid into the subsoil environment.

Another object of the invention is to provide a leachate filtration and distribution system that can efficiently transfer leachate accumulating in one part of the system to other parts of the system.

A further object of the invention is to provide an improved leachate filtration and distribution system comprising core sheets and geotextile fabric with increased subsurface contact area.

Briefly stated, one aspect of the present invention is an assembly comprising a plurality of parallel, alternating core sheets and spacers and at least one transfer sheet adjacent an edge of at least some of the plurality of core sheets. The spacers can be in sheet form.

The core sheets and spacer sheets of the present invention are separated by a leachate permeable geotextile fabric. The geotextile fabric may be wrapped in an over and under serpentine fashion to leave the tops of the core sheets uncovered, but the tops of the spacer sheets covered. Alternatively, the fabric may be disposed between selected core sheets and spacer sheets in other patterns to leave any of the tops or bottoms of any of the core sheets and/or spacer sheets uncovered.

The transfer sheet of the present invention functions to transfer fluid from a supply pipe to the adjacent edges of a plurality of core sheets, for subsequent distribution along a core sheet and through the geotextile fabric into the subsoil environment. Additionally, any fluid accumulating in the area of a first core sheet can flow to the transfer sheet and thereby be redistributed to any other core sheet. The transfer sheet can be variously oriented to the edges of the core sheets. The core sheets, spacer sheets and transfer sheet are preferably secured together, for example with bands or straps. The secured assembly can be overwrapped with geotextile fabric to form a system or indrain.

Another aspect of the present invention is a system comprising a plurality of alternating wide and narrow core sets. Each core set is comprised of parallel, alternating core sheets and spacer sheets. Fabric is disposed between some or all of the core sheets and spacer sheets. The alternating wide and narrow core sets provide multiple outwardly extending arms. The outermost ends of the arms are overwrapped with geotextile fabric. The outwardly extending arms function to provide a geometrical surface area advantage by increasing the system sidewall/soil surface interface area for a given length of leachate system, thereby enhancing leachate drainage to the subsoil environment.

In yet another aspect of the invention the leachate system comprises a plurality of alternating wide and narrow core sets and a transfer sheet adjacent to at least some of the core sheets.

DETAILED DESCRIPTION OF THE INVENTION

Figure 1:
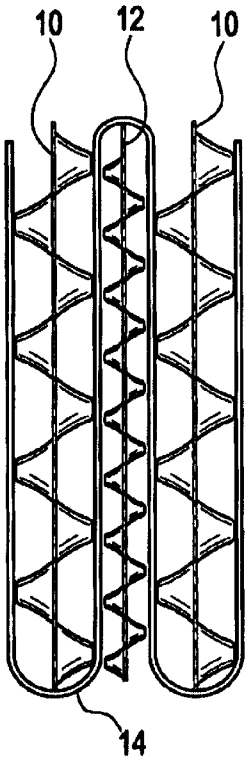
FIG. 1 is a partial, schematic, side view of one aspect of the invention illustrating a spacer sheet disposed between two core sheets, the assembly wrapped with geotextile fabric.

As shown in FIG. 1, the invention in.broadest form encompasses a plurality of alternating parallel core sheets 10 and spacer sheets 12 arranged generally in parallel. The core sheets 10 and spacer sheets 12 are preferably comprised of a polymeric material or materials such as, for example, polystyrene, polyethylene or polypropylene, formed in a generally planar or sheet fashion and having a plurality of arrayed dimples or protrusions extending from one or both faces. The dimple sizes of the core sheets and spacer sheets can be chosen to minimize undesirable nesting of these sheets during handling and use. U.S. Pat. Nos. 4,490,072, 4,880,333 and 6,048,131, the entire disclosures of which are incorporated by reference herein, describe similar sheet materials. Thicknesses of the core sheets 10 and spacer sheets 12, defined as the maximum distance from one face to the opposing face, is not believed to be critical to practice of the invention.

Other variations will occur to those skilled in the art. For example, the core sheet, as well as the spacer sheets, as used in the above-described embodiment of the invention, may be imperforate and formed from a continuous sheet to have a desired dimple shape. One or both of the core sheets and spacer sheets can be provided of a perforated material. Still another alternative would be to provide imperforate core sheets and/or spacer sheets with openings for purposes of transferring fluid from one side of such sheet to the other. A further alternative would be to provide porous core sheets and/or spacer sheets. A still further alternative is to provide partial spacer sheets, or a single or multiple non-sheet spacers between adjacent core sheets.

Figure 2:
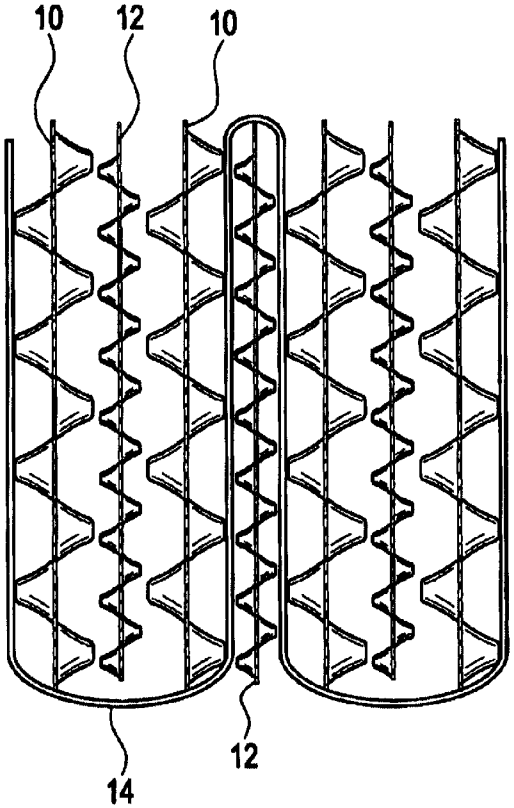
FIG. 2 is a view similar to FIG. 1, illustrating a different embodiment of the invention.
Figure 11:
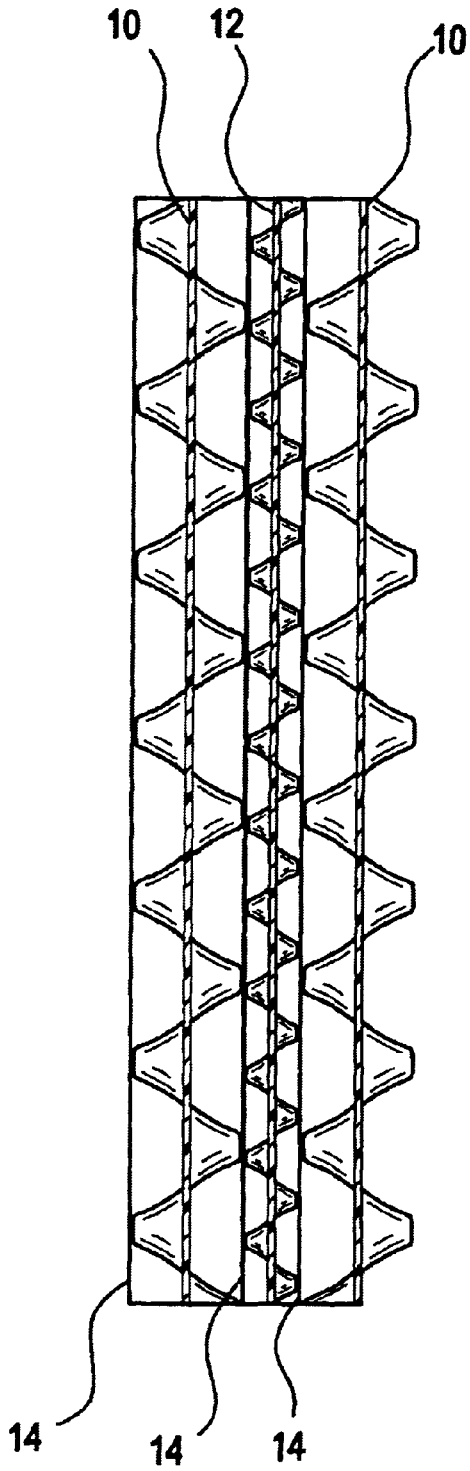
FIG. 11 is a view similar to FIG. 1, illustrating an aspect of the invention wherein geotextile fabric sheets are disposed between alternating core sheets and spacers to leave the top and bottoms of the core sheets and spacers uncovered.

Fluid permeable geotextile fabric 14 is disposed between some or all of the core sheets 10 and spacer sheets 12. The geotextile fabric is typically a polymeric, nonwoven needle-punched fabric known in the art. TNS R050 fabric available from TNS Advanced Technologies of Spartanburg, S.C. has been found suitable for this use. The fabric functions in one aspect to provide surface area for the formation of a biological mat. Fluid, such as leachate from a septic system is beneficially cleansed by the biological mat as it permeates through the fabric and mat into the soil. The fabric is advantageously disposed between sheets 10, 12 in an over and under serpentine fashion as shown in FIG. 1. Naturally, other wrapping patterns (for example a side to side serpentine pattern) and spacings (for example under a core sheet/spacer/core sheet set, over a spacer, and under a core sheet/spacer/core sheet set as shown in FIG. 2) could also be used depending on the fabric surface area and flow paths desired. Alternatively, as shown in FIG. 11, geotextile fabric may be taken from a roll or in cut sheet form and placed adjacent a first side of a core sheet and a spacer sheet. Assembling alternating sequences of a core sheet, fabric sheet and spacer sheet provides a fabric/core sheet/fabric/spacer sheet set as shown in FIG. 11. In this embodiment, the upper and lower edges of the core sheets and spacers may be left uncovered to aid in distribution of high leachate flows. Naturally, in any embodiment the patterns would be repeated as needed to arrive at a structure having a desired size and surface area. The geotextile fabric may be joined to the core sheet and/or spacer sheet by, for example, heat bonding, adhesive bonding or mechanical fastening, to make assembly easier. It should be understood that other, alternative fabric wrapping patterns and sheet and fabric spacings are within the skill of the ordinary practitioner and are fully comprehended by the present invention. Typically, in any embodiment, it is preferred that geotextile fabric is also disposed over the uncovered top, side and ends of a system (but typically not the bottom) to prevent soil infiltration into the system during backfilling. The previously mentioned TNS R050 fabric can be disposed over the top, sides and ends of the system. However, this fabric is prone to stretching and under some conditions the bands can stretch the fabric into the sides of the system. It has been found preferable in some applications to use a thinner and stiffer geotextile fabric to ease handling and minimize fabric stretch. TYPAR® 3401, available from Remay Industrial Fabrics, Inc. of Madison, Tenn., is a geotextile fabric that is stiffer than the TNS R050 fabric. TYPAR® 3401 has been found suitable for use adjacent the top, sides and ends of the system. TYPAR® 3401 also preferably minimizes infiltration of soil into the system.

Figure 8:
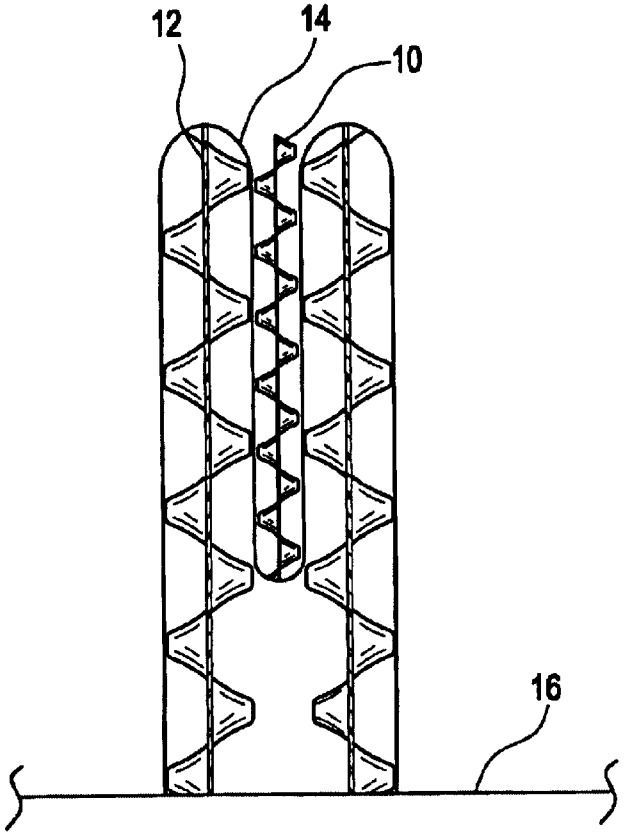
FIG. 8 is a view similar to FIG. 1, illustrating another embodiment of the invention.

In an embodiment of the invention shown in FIG. 8, the core sheets 10 and spacer sheets 12 have differing heights above the underlying soil bed 16. When geotextile fabric 14 is disposed between the core sheets 10 and spacer sheets 12, a portion of the core sheet 10 and fabric 14 is suspended above the underlying soil bed 16. Suspension of the fabric 14 away from the underlying soil bed enhances biological growth on the fabric and thereby filtering efficiency of the system.

Figure 3:
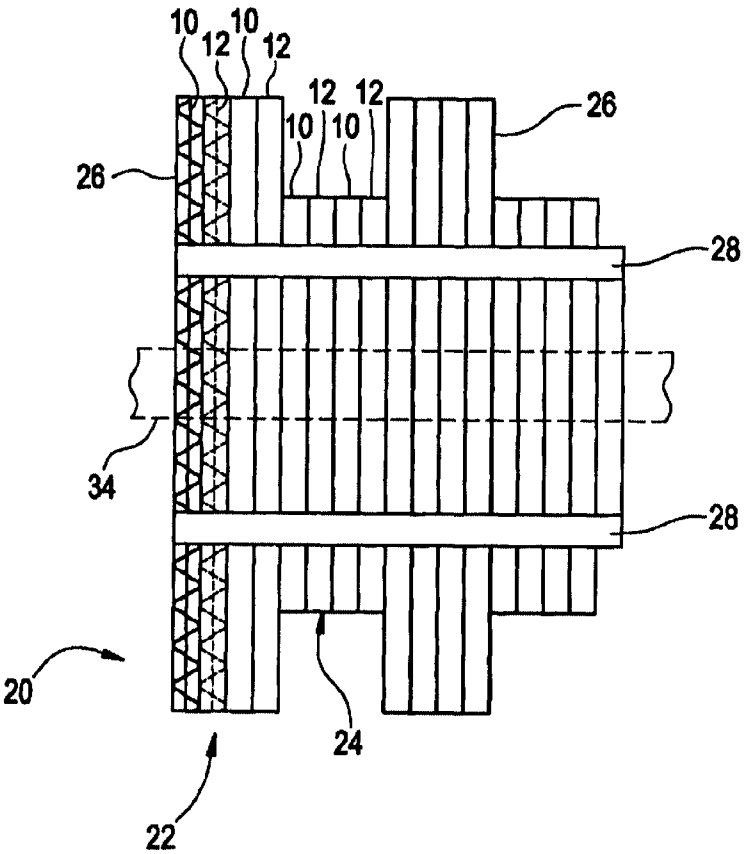
FIG. 3 is an schematic, top plan view, partially in phantom, of one aspect of the invention illustrating alternating wide and narrow core sets.

As shown in FIG. 3, another aspect of the present invention is a subsoil fluid distribution system 20 comprised of alternating wide 22 and narrow 24 core sets. Advantageously, an outermost edge of a wide core set 22 can extend about twelve inches beyond the edge of a narrow core set 24. Preferably, the outermost edge of a wide core set 22 will extend from about three inches to about twelve inches beyond the edge of a narrow core set 24. Each core set 22, 24 is comprised of alternating parallel core sheets 10 and spacers or spacer sheets 12 arranged in face to face order. Leachate permeable geotextile fabric 14 (not shown in FIG. 3 for clarity) is disposed between some or all of the core sheets 10 and spacer sheets 12. Preferably, the fabric 14 is wrapped in a serpentine pattern over each spacer sheet 12 and under each core sheet 10 as shown in FIG. 1.

With reference again to FIG. 3, the arm portions 26 of each wide core set 22 extending beyond the narrow core set 24 are covered with geotextile fabric, preferably in the form of a sock or sheath (not shown) placed over and secured to the arm 26. A fabric stiffer than the TNS R050 fabric is advantageous for use in this application.

The wide 22 and narrow 24 core sets are placed in alternating sequence, and secured to each other, for example with straps or bands 28, to form the inventive system 20.

In use, the above system 20 is placed in a previously prepared excavation and supported on a soil bed 16. A fluid supply 34 is placed adjacent the system 20. It should be noted that the fluid supply 34 may be placed in orientations to the system 20 other than the one shown, (for example, within the system or adjacent the system side) and any and all orientations are included in the invention. The fluid supply 34 typically comprises perforated plastic pipe. An additional layer of geotextile fabric (not shown) can preferably be placed over the fluid supply 34 and top of the system 20 and over exposed edges of the sheets 10, 12 to prevent infiltration of the leachate system by the subsequently placed backfill. It should be understood that geotextile fabric 14 may be positioned and secured adjacent exposed edges of the system 20 during manufacturing. Backfill such as sand is placed around and over the system 20 and leachate supply 34. In use, fluid such as leachate is carried by the fluid supply pipe 34, and discharged over or into the system 20. The leachate travels through the geotextile fabric underlying the pipe 34 (not shown in FIG. 3) and along the core sheets 10, spacer sheets 12 and fabric 14 into the subsoil environment. The outwardly extending arms 26 of the wide core sets 22 function to provide a geometrical surface area advantage and increase the sidewall/soil interface area for a given length of leachate system 20, thereby enhancing leachate filtration and drainage into the subsoil environment. Naturally, other configurations of core sheets 10 and spacer sheets 12 that provide increased sidewall/soil interface area would occur to those skilled in the art, for example polygonal or other arrangements, and all such variations are encompassed by this invention.

Figure 4:
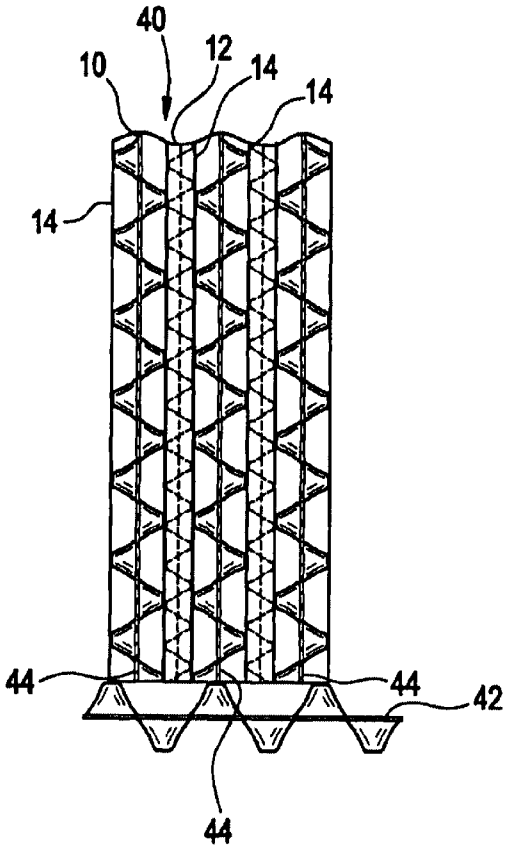
FIG. 4 is a partial, schematic, top plan view of another aspect of the invention, illustrating parallel core sheets separated by spacer sheets (shown in phantom) and a transfer sheet perpendicular to the core sheets.
Figure 6:
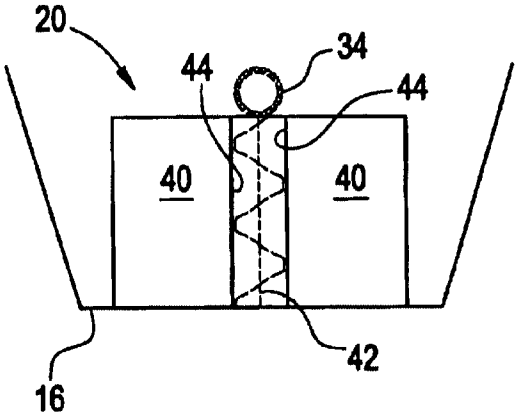
FIG. 6 is a schematic end view of an embodiment of the invention having a fluid supply (shown in section) overlying a vertically arranged transfer sheet (also shown in section)
Figure 7:
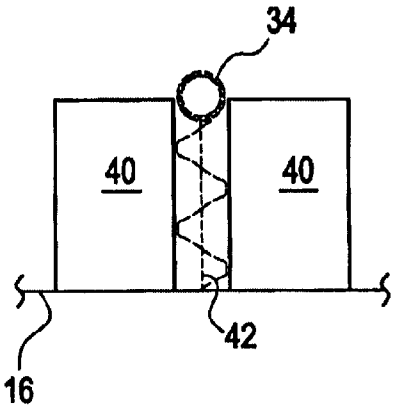
FIG. 7 is a view similar to FIG. 6, showing another embodiment of the invention.

In another aspect of the invention partially shown in FIG. 4, a core set 40 comprising alternating parallel sequences of core sheets 10 and spacers or spacer sheets 12 is provided. Geotextile fabric 14 is disposed between some of the alternating sequences, preferably in the above described over and under serpentine fashion shown in FIG. 1. In some variations certain of the core sheets 10 and under wrapped fabric 14 are raised as shown in FIG. 8, so that these core sheets and underlying fabric will be above the underlying soil bed 16 when the system 20 is in use. A transfer sheet 42 is placed adjacent to, or abutting, at least some of the edges 44 of the core sheets 10. The transfer sheet 42 can be comprised of the same materials and in the same configurations as the core sheets 10. The transfer sheet can be perforated or permeable to leachate. The transfer sheet does not have to extend over the entire depth of the core set edge to the underlying soil 16, as shown in FIG. 6, but may extend along only a portion of the depth thereof. Naturally, multiple overlapping transfer sheets may be used to obtain coverage of substantially the entirety of all of the core sheet edges 44.

Geotextile fabric 14 (not shown in FIG. 6 for clarity) can advantageously be disposed adjacent some or all of the transfer sheet 42 faces, transfer sheet top edge and transfer sheet bottom edge. The previously mentioned TNS R050 fabric can be used adjacent the transfer sheet 42. However, this fabric is prone to stretching and under some conditions the core sheet edges 44 can stretch the fabric into contact with the transfer sheet 42. It has been found advantageous in some applications to use a stiffer geotextile fabric to minimize fabric stretch. TYPAR® 3401 has been found suitable for use adjacent the transfer sheet 42.

The core sets 40, transfer sheet 42 and geotextile fabric 14 are secured together for handling, for example with plastic bands or straps to provide an assembly. Geotextile fabric 14 may be positioned and secured over the exposed top, side and/or edges of the assembly to prevent soil infiltration during later back filling. While a core set 40 on one side of the transfer sheet 42 has been described for clarity, it should be understood that core sets 40 on both sides of the transfer sheet 42 as shown in FIG. 6 are fully comprehended by the invention. In one preferred embodiment, a series of alternating core sheets 10 and spacer sheets 12 is wrapped serpentine fashion with fabric 14 as shown in FIG. 1 to form a core set. The core set may be secured with one or more straps or bands if desired. A transfer sheet 42 is disposed adjacent to, and perpendicular with, the exposed edges of at least some of the core sheets 10 to form an assembly. Additional fabric can be used to cover some or all of the ends and sides of the assembly, and the covered assembly is secured with straps or bands 28 to form a system 20. Typically, the top of the system 20 is covered with geotextile fabric during installation of the system.

Figure 9:
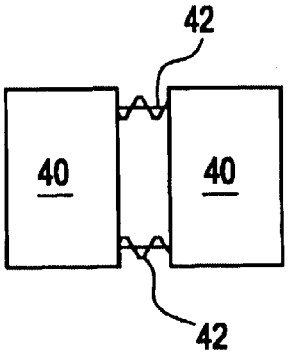
FIG. 9 is a schematic end view of an embodiment of the invention having horizontally arranged transfer sheets.
Figure 10:
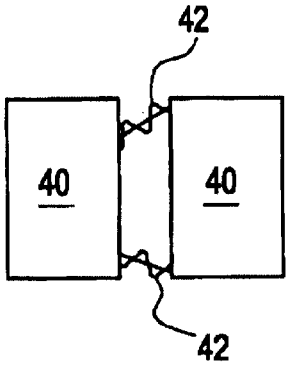
FIG. 10 is a view similar to FIG. 9, showing another embodiment of the invention having angularly arranged transfer sheets.

The transfer sheet 42 provides a route for fluid communication between the fluid supply 34 and some or all of the core sheets 10 as well as between some or all of the core sheets 10 and/or spacer sheets 12 themselves. The transfer sheet 42 (or multiple transfer sheets) may also be provided horizontally as shown in FIG. 9 or angularly as shown in FIG. 10 with respect to the core sets 40. While two sheets 42 are shown in FIGS. 9 and 10 it is believed that additional sheets would be advantageous to maintain separation of the spaced core sets 40 when the assembly is secured. Provision of the transfer sheet or sheets other than vertically may require the transfer sheets to be permeable or perforate so that some leachate can pass therethrough. It is also preferred that transfer sheets in other than vertical orientations be arranged to prevent nesting and the resultant diminished leachate flow. The arrangements may include, for example, using transfer sheets with alternating dimple sizes or provision of spacers between adjacent transfer sheets. In other variations the transfer sheet edge abutting the core set is notched or slotted. The slotting allows the transfer sheet to interengage with the abutting core sheets as shown in FIG. 10.

In one typical use, the above system 20 is placed in a previously prepared excavation 46 and supported on a soil bed 16 as shown in FIG. 6. A fluid supply pipe 34 is placed adjacent the system 20. It should be noted that the fluid supply pipe 34 may be placed in orientations to the system 20 other than the one shown, (for example, within the system or adjacent the system side) and any and all orientations are included in the invention. At least a portion of the fluid supply pipe 34 typically comprises perforated plastic pipe. The fluid supply pipe 34 is fluidly connected to a fluid source such as a septic tank or septic system. A layer of geotextile fabric (not shown) can preferably be placed over the supply pipe 34 and top of the system 20 and over exposed edges of the sheets 10, 12 to prevent infiltration of the leachate system by the subsequently placed backfill. It should be understood that the layer of fabric 14 and/or supply pipe 34 may be positioned and secured adjacent the system 20 during manufacturing. Backfill such as sand is placed around and over the system 20 and supply pipe 34. Leachate flows from the source through the pipe 34 into the system 20, where it travels along the transfer sheet faces to an adjacent core sheet edge 44. Leachate travels from the edge 44 along the core sheet faces and through the fabric 14 into the subsoil environment. The transfer sheet 42 typically provides leachate with a fluid communication route to all of the core sheets, improving leachate transfer, filtration and distribution into the soil environment. Additionally, any leachate accumulating adjacent one core sheet will flow by gravity back to the transfer sheet 42 and thence to any core sheet 10 with a lower leachate level. Thus, the present invention is less susceptible than previous systems to decreasing of leachate flow into the subsoil environment. Since the transfer sheet 42 provides a fluid communication path to all of the core sheets 10 and/or spacer sheets 12 of the system, particular dimensional relationships between the core sheets, spacer sheets and leachate supply are not needed.

Figure 5:
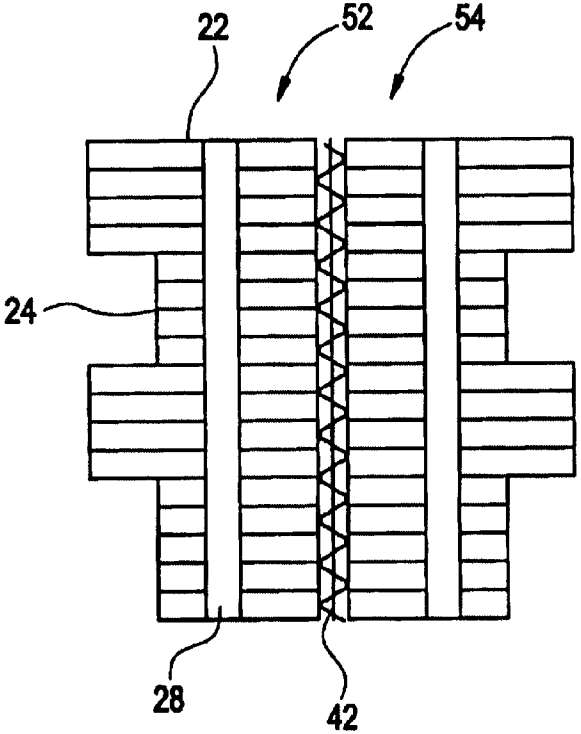
FIG. 5 is a schematic, top plan view of another aspect of the invention, illustrating wide and narrow core sets with a transfer sheet perpendicular to the core sheets.

In another embodiment shown in FIG. 5, the alternating wide 22 and narrow 24 core sets previously described may be provided on one or both sides of a transfer sheet 42 to form the subsoil fluid distribution system 20. At present, the best method known for manufacture of this embodiment comprises manufacture of an alternating wide and narrow core set assembly as shown in FIG. 3. The core set assembly is sectioned transversely into longitudinal sections 52, 54. A transfer sheet 42 is disposed in the separation between each section 52, 54. Fabric is disposed over the top, sides and ends of the sections end transfer sheet. The sections, transfer sheets and any geotextile fabric are secured, for example, with bands or straps. The use of alternating wide 22 and narrow 24 core sets in combination with a transverse transfer sheet 42 combines the benefits of additional system sidewall/subsoil interface area and leachate fluid communication between all of the core sheets 10 and spacer sheets 12.

Figure 12:
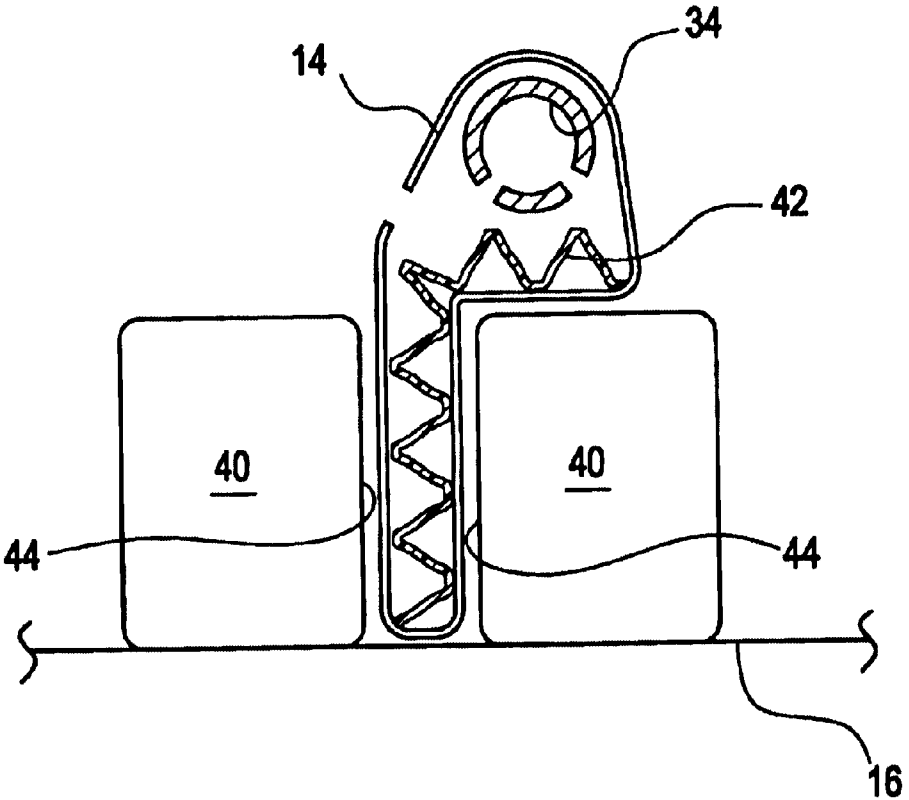
FIG. 12 is a view similar to FIG. 6, illustrating another aspect of the invention.

In another embodiment of the invention shown in FIG. 12, an angular transfer sheet 42 is disposed over portions of the top and portions of one edge 44 of a core set 40. Advantageously, the transfer sheet is perforated and wrapped with geotextile fabric 14. In one embodiment the fabric envelops the angular transfer sheet and the edges of the fabric 14 are over lapped and attached, as by, for example, sewing, thermal bonding or adhesive bonding. The fluid supply pipe 34 is positioned adjacent the angular transfer sheet. The fluid supply 34 may be covered with a separate layer of geotextile fabric. Alternatively, the geotextile fabric enveloping the angular core sheet can be sized to permit the insertion of the fluid supply as shown in FIG. 12. In another variation, the angular transfer sheet 42 is disposed intermediate two core sets. In still another variation of the invention, multiple angular transfer sheets are disposed between multiple core sets. The angular transfer sheet functions to provide a fluid communication route from the supply to the edges of the adjacent core set or core sets. The angular transfer sheet also provides a fluid communication route between any core sheet or spacer sheet adjacent the transfer sheet.

Typically, the system will have a width of about four feet and a length of about four feet. Multiple systems can be placed end to end to provide any desired system length. It should be understood that the above dimensions are primarily due to commercial considerations and are not limitations on the present invention, which contemplates a broad range of system widths and lengths. In any embodiment where soil conditions do not allow desired system length, additional subsoil fluid distribution systems can be provided or multiple systems can be stacked vertically one above another. Another variation that will occur to those skilled in the art is to provide more than one fluid supply pipe, over a fluid distribution system of the type described above.

While preferred embodiments of the foregoing invention have been set forth for purposes of illustration, the foregoing description should not be deemed a limitation of the invention herein. Accordingly, various modifications, adaptations and alternatives may occur to one skilled in the art without departing from the spirit and scope of the present invention.

What is claimed is:

1. A system for fluid distribution into subsurface soil, comprising:

a wide core set having a width greater than a first width and comprising two adjacent wide core sheets in face to face relationship, each wide core sheet having a top edge, a bottom edge, a first outside edge connecting the top edge to the bottom edge and an opposing second outside edge connecting the top edge to the bottom edge, means for spacing the adjacent wide core sheets, and fluid pervious fabric disposed between one said wide core sheet and the means for spacing the adjacent wide core sheets; and a narrow core set having a width less than a first width and comprising two adjacent narrow core sheets in face to face relationship each narrow core sheet having a top edge, a bottom edge, an outside edge connecting the top edge to the bottom edge and an inside edge connecting the top edge to the bottom edge, means for spacing the adjacent narrow core sheets, and fluid pervious fabric disposed between one said narrow core sheet and the means for spacing the adjacent narrow core sheets;

wherein the wide and narrow core sheets are in substantially parallel arrangement, the outside edge of the said wide core sheet sheets extends beyond the outside edge of the narrow core sheets and the wide core set and narrow core set are secured to each other.

2. The system of claim 1, comprising a core sheet substantially perpendicular to one outside edge of each said wide core sheet.

3. The system of claim 1, comprising a core sheet substantially perpendicular to one outside edge of each said wide core sheet and one outside edge of each said narrow core sheet.

4. The system of claim 1, comprising a plurality of wide core sets and a plurality of narrow core sets arranged in alternating order.

5. The system of claim 1, comprising a plurality of wide core sets and a plurality of narrow core sets arranged in alternating order and a generally planar core sheet adjacent to, and in fluid communication with, each wide core sheet first outside edge in at least one wide core set and substantially perpendicular to each wide core sheet top edge in at least one said wide core set.

6. The system of claim 1, wherein the means for spacing the wide core sheets is selected from a spacer sheet, a dimpled spacer sheet, a perforated spacer sheet, a partial spacer sheet and a non-sheet spacer.

7. The system of claim 1, comprising at least two parallel rows with each row comprising a plurality of wide core sets, and a plurality of narrow core sets, with the narrow core sheets being substantially parallel to the wide core sheets and arranged in alternating order with the wide core sets; and a generally planar core sheet disposed between the rows generally perpendicularly to the wide core sheets, wherein a fluid communication route is defined between a first core sheet abutting the transfer sheet and another core sheet abutting the transfer sheet in a different core set.

8. The system of claim 1, comprising a substantially planar core sheet without dimples abutting an edge of the each wide core sheet, wherein the abutting edge of each wide core sheet is not covered by fluid pervious fabric.

9. A subterranean fluid distribution system comprising:

a plurality of core sheets in spaced, parallel arrangement defining at least two rows, each core sheet having a top edge, a bottom edge and opposing first and second side edges connecting the top and bottom edges, the core sheet first side edges in one said row adjacent the core sheet second side edges of another said row;

a plurality of spacers, each spacer disposed between adjacent core sheets;

fluid pervious fabric disposed between one said core sheet and an adjacent spacer; and a transfer core sheet disposed in a substantially Perpendicular fashion between two rows of core sheets and providing fluid communication between one core sheet and another core sheet.

10. The system of claim 9, wherein the transfer core sheet is adjacent to an edge portion of one said core sheet.

11. The system of claim 9, wherein the transfer core sheet is adjacent a top portion and a side portion of one said core sheet.

12. The system of claim 9, comprising multiple transfer core sheets.

13. The system of claim 9, wherein the plurality of core sheets define alternating wide and narrow core sets.

14. The system of claim 9, wherein the transfer core sheet functions to provide fluid communication between non-adjacent core sheets.

15. The system of claim 9, wherein the transfer core sheet defines apertures therein.

16. The system of claim 9, disposed on a subsurface bed wherein at least one core sheet has the bottom edge at least about 1.5 inches above the subsurface bed.

17. The system of claim 9, comprising a top surface, opposing side surfaces and opposing end surface, wherein an envelope of fluid permeable fabric is disposed over a majority of each of the top, side and end surfaces.

18. The system of claim 9, wherein the transfer core sheet comprises opposing first and second faces and wherein the first side edge portion of one said core sheet is adjacent the first face and the second side edge portion of another said core sheet is adjacent the second face.

19. The system of claim 9, wherein the transfer core sheet comprises a core sheet that equally bisects the rows of core sheets.

20. The system of claim 9, wherein each said spacer is selected from a spacer sheet, a dimpled spacer sheet, a perforated spacer sheet, a partial spacer sheet and a non-sheet spacer.

21. The system of claim 9, wherein the a transfer core sheet defines a notch in a first edge portion and the notch is interengaged with a portion of one said core sheet side edge.

22. A system for filtration and distribution of fluid into a subsurface environment comprising a support a plurality of substantially parallel space sheets each having a lower edge contacting a subsurface bed; a raised core sheet within the plurality of substantially parallel space sheets, the raised core sheet having a lower edge spaced from the subsurface bed; and fabric at least partially surrounding the raised core sheet lower edge, the fabric spaced from the subsurface bed.

23. The system of claim 22, wherein the fabric is disposed in a serpentine fashion over a top edge of one space sheet in the plurality of substantially parallel space sheets, between the one space sheet in the plurality of substantially parallel space sheets and an adjacent face of the raised core sheet, under the lower edge of the raised core sheet and along an opposing face of the raised core sheet.

24. A subterranean fluid distribution system having a length defining a length axis, a first width defining a width axis, a depth defining a depth axis and comprising:

a plurality of core sheets arranged generally parallel to the system width axis;

a plurality of spacers, each spacer disposed between adjacent core sheets;

fluid pervious fabric disposed between one said core sheet and an adjacent spacer; and a core sheet generally perpendicular to the system width axis and generally parallel with the system depth axis, wherein the core sheet generally perpendicular to the system width axis provides fluid communication between one core sheet generally parallel to the system width axis and another core sheet generally parallel to the system width axis.

25. The system of claim 24 wherein the core sheet generally perpendicular to the system width axis comprises an angular core sheet having an L shape with a portion perpendicular to the system depth axis.

26. The system of claim 24 wherein the plurality of the core sheets generally parallel to the system width axis each comprise a top edge, a bottom edge and opposing first and second side edges connecting the top edge to the bottom edge, and the core sheet generally perpendicular to the system width is adjacent each of the first or second side edges.

* * * * *

UNITED STATES PATENT AND TRADEMARK OFFICE

CERTIFICATE OF CORRECTION

PATENT NO. : 6,659,687 B1
DATED : December 9, 2003
INVENTOR(S) : Donolin et al.

It is certified that error appears in the above-identified patent and that said Letters Patent is hereby corrected as shown below:

Column 8,
Line 27, after "core" delete "sheet".

Column 9,
Lines 9-10, delete "Perpendicular" and insert -- perpendicular --.

Column 10,
Line 1, before "transfer" delete "a".
Line 5, after "comprising" delete "a support".
Lines 6, 8, 13, 14, 15 and 16, delete "space" and insert -- spacer -- therefor.

Signed and Sealed this

Twenty-second Day of March, 2005

JON W. DUDAS
*Director of the United States Patent and Trademark Office*